United States Patent [19]
Siegel et al.
[11] 4,318,260
[45] Mar. 9, 1982

[54] STRAP SYSTEM FOR SUPPORTING INSULATION IN BUILDINGS

[75] Inventors: Bart A. Siegel; Hal S. Hughes, Jr.; Winston M. Mullins, all of Knoxville, Tenn.

[73] Assignee: Insulation Materials, Inc., Knoxville, Tenn.

[21] Appl. No.: 12,338

[22] Filed: Feb. 15, 1979

[51] Int. Cl.[3] ..... E04B 2/00
[52] U.S. Cl. ..... 52/407; 52/410; 52/712

[58] Field of Search ..... 52/712, 410, 357, 407, 52/404, 721; 24/20 EE, 17 B, 21, 22, 24, 25, 230 BC, 230 AL, 230 R, 222 R

[56] References Cited

U.S. PATENT DOCUMENTS 188,607 3/1877 Drake .
196,438 10/1877 Drake .
219,600 9/1879 Simmons .
1,247,253 11/1917 Fletcher .
1,687,854 10/1928 Anderson .
1,854,125 4/1932 Faber ..... 24/222 R
2,059,906 11/1936 Prestwich .
2,293,509 8/1942 Leslie .
3,235,924 2/1966 Timmerbeil .
4,069,636 1/1978 Kessler ..... 52/357 X
4,075,806 2/1978 Alderman ..... 52/407 X

FOREIGN PATENT DOCUMENTS 1064464 5/1954 France ..... 24/20 EE

*Primary Examiner*—Price C. Faw, Jr.
*Assistant Examiner*—Carl D. Friedman
*Attorney, Agent, or Firm*—Luedeka & Fitch

[57] ABSTRACT

A strap system for securing insulation batts in position relative to depending purlins of a building. The strap system includes first and second strap members each having keyhole-type slots in respective ends thereof and button means for fastening the straps one to another.

5 Claims, 12 Drawing Figures

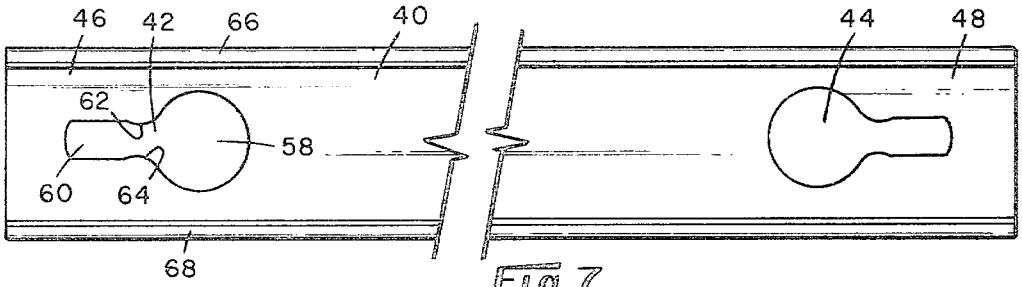
Fig. 7
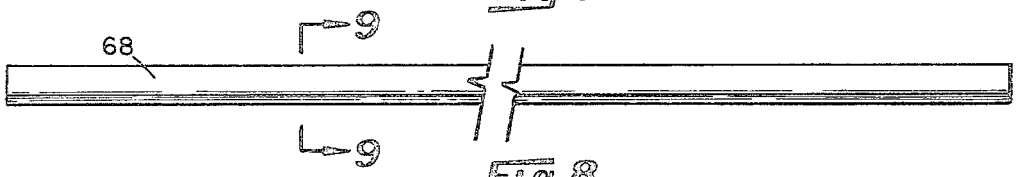
Fig. 8
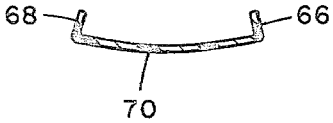
Fig. 9
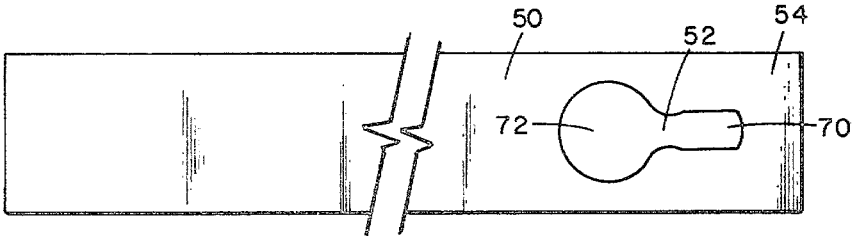
Fig. 10
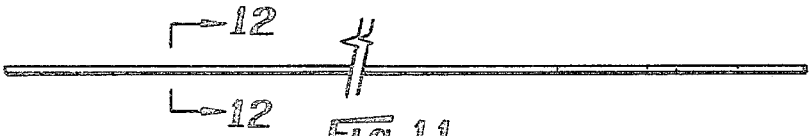
Fig. 11
Fig. 12

STRAP SYSTEM FOR SUPPORTING INSULATION IN BUILDINGS

This invention relates to strap systems and particularly to a strap system for securing insulation batts in the ceiling of a building.

Metal buildings of the type comprising a skeletal framework covered by sheet material, for example, have become popular because of their relatively low cost and the speed with which they can be erected. Such buildings, however, suffer from the difficulty of insulating the walls and/or roof against the transfer of heat out of the building during cold weather and into the building during hot weather.

In a common type of metal building, the roof thereof comprises a plurality of spaced apart elongated purlins which serve to support the roof covering. These purlins commonly are exposed on the inside of the building and include a web portion that depends from the general plane of the roof. The distal edge of each purlin web portion commonly terminates in a flange which extends generally laterally from the web portion.

Heretofore the ceiling of such a metal building has been insulated by disposing batts of fibrous insulation between the purlins and securing the batts in place by various means that extend between adjacent purlins. For example, such batts have been held in place by solid sheets of rigid material fastened to the purlins or otherwise supported by the purlins, wire netting strung between purlins, straps that extend between adjacent purlins, and straps that extend between several purlins.

One insulation supporting strap is shown in U.S. Pat. No. 4,069,636 and comprises an elongated member having a female end and an opposite male end. These ends are so shaped as to permit female-to-female end-to-end connection of two or more straps, plus simultaneous engagement of each joinder of the ends with a purlin flange.

Another strap known heretofore comprises an elongated bendable metal member having a plurality of slots cut transversely of the length dimension of the strap at each of its ends and inwardly of the side edge thereof by a distance approximately equal to one-half the width of the strap. The slots adjacent one end of a given strap open outwardly along the left-hand side margin of the strap and the slots on the opposite end of the same strap open outwardly along the right hand side margin of the strap so that the straps can be joined end-to-end by engaging a slot on one end of a first strap in an oppositely oriented slot on one end of a second strap. These straps when joined end-to-end, by design, have about 6 to 10 inches of "excess" from one of the straps which extends from the joinder situs and which is bendable around a purlin flange to secure the straps to the purlins and thereby hold the insulation in place.

Each of these prior means for securing ceiling insulation in place possesses one or more disadvantages such as for example, cost of the materials, cost and/or difficulty in installation, low fire rating, etc.

According to the present disclosure, there is provided a strap system for securing insulation batts in position relative to depending purlins having generally laterally extending cantilevered flange portions including a first elongated semi-rigid strap member of a length sufficient to span the distance between the approximate longitudinal centerlines of adjacent purlins, a second elongated bendable strap member of a length substantially less than the length of the first strap member, means defining a slot in each of the opposite ends of the first strap member, means defining a slot in one end of the second strap member, and button means simultaneously receivable in a slot in one end of the first strap member and the slot in the end of the second strap member when these slots are in register, and which serves to connect such ends of the strap members one to another. Further, as disclosed, one end of a further first strap member is connectable in end-to-end relationship with the first strap member by causing a slot in its end to be simultaneously engaged by the button which connects the ends of the first and second strap members. In its preferred embodiment, the present system comprises a plurality of first and second strap members with the several first strap members being connected in end-to-end relationship and individual ones of the second strap members being connected to the first strap members at their joinder sites. In a preferred embodiment, the slots each are of a keyhole geometry and the button comprises two disc-shaped heads that are joined to one another in substantially parallel relationship by a shaft means.

It is therefore an object of this invention to provide an improved strap system, specifically a strap system suitable for securing batts of insulation relative to the purlins of a building. It is another object of this invention to provide a strap system wherein the materials of construction of the strap are relatively inexpensive and readily installed. Other objects and advantages of the invention will be recognized from the following description and claims, including the drawings, in which:

FIG. 7 is a plan view of a first strap member of the system disclosed herein;

FIG. 8 is a side elevational view of the first strap shown in FIG. 7;

FIG. 9 is a cross-sectional view of the first strap member shown in FIG. 7;

FIG. 10 is a plan view of a second strap member of the system disclosed herein;

FIG. 11 is a side elevational view of the second strap member shown in FIG. 10; and FIG. 12 is a cross-sectional view of the second strap member shown in FIG. 10.

Figure 1:
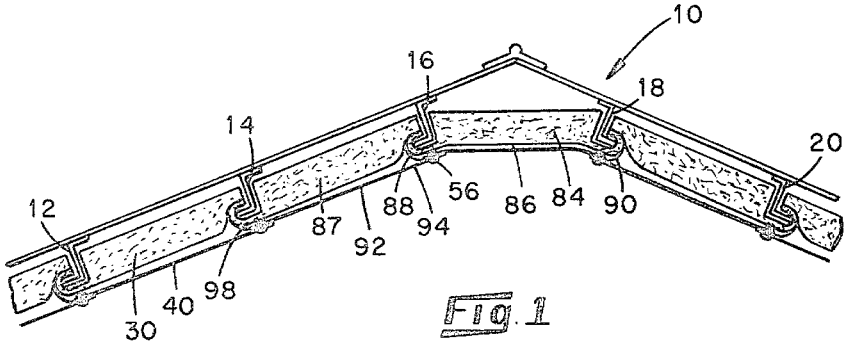
FIG. 1 is a representation of a portion of a building roof and ceiling in which there is installed insulation held in place by a strap system as disclosed herein.
Figure 2:
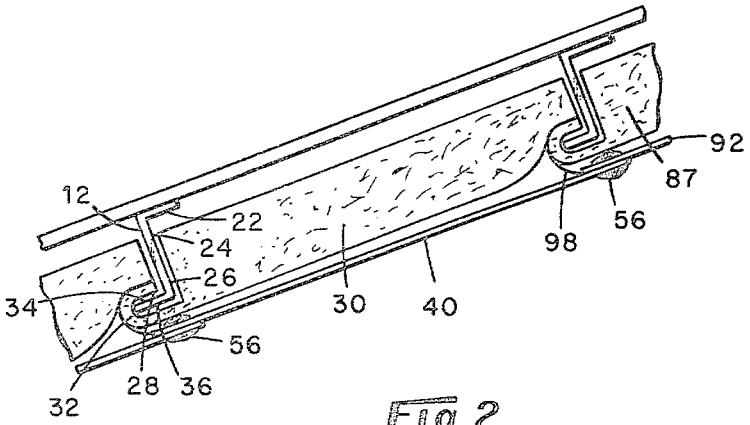
FIG. 2 is a fragmentary enlarged view of a portion of the system depicted in FIG. 1.
Figure 3:
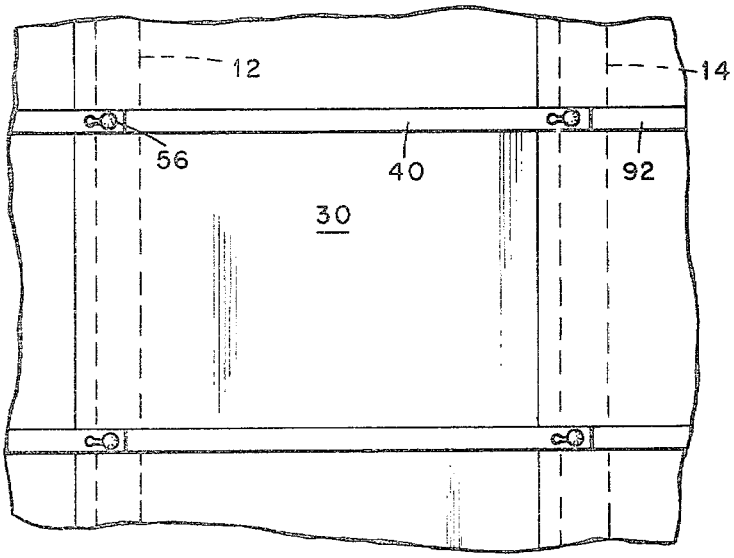
FIG. 3 is a view looking up from below the ceiling depicted in FIG. 1 and showing a portion of the insulation as held in place by the disclosed strap system.

Referring to FIGS. 1–3, there is shown a portion of a building roof indicated generally by the numeral 10. The depicted roof 10 comprises a plurality of elongated purlins 12, 14, 16, 18 and 20, which extend in generally parallel relationship one to another, generally from one end of the building to the other end. These purlins commonly are supported by various means, depending upon the type of building construction employed, as is known in the art. As depicted in FIGS. 1–3, each of the purlins is of a generally "Z" shaped cross-section and comprises a planar flange 22 lies adjacent to and substantially parallel to the plane of the roof 10. Each purlin further comprises a web portion 24 which is integrally connected to the flange portion 22 and depends generally from the plane of the roof 10. The distal end 26 of the purlin web portion 16 has provided thereon a bottom flange 28 which extends generally laterally from the web portion 24. As shown in FIG. 2, the bottom flange portion 28 of the several purlins extend away from their respective web portions in the same general direction. That is, each of the bottom flanges is pointed generally downwardly with the incline of the roof.

There is depicted an elongated generally planar batt of insulation 30 which extends from the web portion of one purlin in a direction generally parallel to the roof of the building, to the web portion of an adjacent purlin and which continues as a reduced thickness, longitudinal edge tab 32 around the bottom flange 28 of the purlin 12, for example, in wrapping engagement thereof to cover both the upper and lower surfaces 34 and 36, respectively, of the flange 28. Substantially identical batts are provided from one purlin to and in wrapping engagement with an adjacent purlin over the entire ceiling of the building in like manner.

In accordance with the present disclosure, these batts of insulation 30 are held in position relative to the purlins by a strap system comprising a first elongated strap member 40 having a length equal to at least the distance between the longitudinal center lines of adjacent purlins and having at least one slot 42 and 44 adjacent each of its opposite ends 46 and 48, respectively, thereby making these slotted ends mirror images of one another. The present system further includes a second elongated strap member 50 of a bendable material having a slot 52 in one of its ends 54, and a fastening member 56 adapted to be received through a slot in one end of the first strap member and a slot in the end of the second strap member when these slots are in proper register and to secure the two members one to another.

As shown in FIG. 7, the first strap member 40 is of a length sufficient to extend between adjacent purlins, for example, 48 inches. The depicted strap member is provided with at least one slot 42 in one of its ends 46 and at least one slot 44 in its opposite end 48. Each of these slots, preferably, is of a "keyhole" geometry, including a relatively open end portion 58 which transists into a relatively narrow portion 60. The juncture between the open portion and the narrow portion of each slot preferably is provided with protrusions 62 and 64 on opposite sides thereof for purposes which will appear hereinafter. It is noted that the slots 42 and 44 are of identical geometry but are so oriented with respect to the longitudinal dimension of the strap member 40 that the relatively narrow portion 60 of each slot at each end of the strap member is nearer its respective end of the strap member than is the relatively open portion 58 of the slot.

The depicted first strap member 40 preferably is of a plastic material such as Geon 8700A vinyl rigid extrusion compound available from B. F. Goodrich Chemical Company, Cleveland, Ohio. For supporting fiberglass insulation batts, it is preferred to employ a first strap member having a generally U-shaped cross-section as best seen in FIG. 9, having a thickness of about 0.040 inches and an overall width of about 1.338 inches. This strap member thus possesses longitudinal side edges 66 and 68 which extend upwardly from a central base web 70 by a distance of about 0.220 inches. As also seen in FIGS. 8 and 9, the central web portion 70 of the depicted first strap member 40 is slightly curved about its longitudinal centerline. This curvature, in combination with the upstanding longitudinal side edges 66 and 68, imparts rigidity to the member and reduces crease possibilities.

Referring specifically to FIGS. 10–12, the depicted second strap member 50 of the disclosed system comprises a length of Type 3003 aluminum (half hard) having a thickness of about 0.040 inches and a width of about 1.25 inches. A typical length for this second strap member 50 is nine inches. In any event, the length is sufficient to permit the strap member to wrap a purlin flange 28 as will be referred to further hereinafter. Notably, this second strap member 50 is of a material which is bendable, for example aluminum, but which, when bent, retains its bent state, thereby being capable of storage in a flat condition, but readily bendable in the field for easy installation. One end 54 of the second strap member is provided with a "keyhole" shaped slot 52 of the type described hereinabove. The orientation of the slot in this second strap member 50 is like the orientation of the slots in the first strap member, that is, the relatively narrow portion 70 of the slot 52 is nearer its respective end 54 of the strap member 50, relative to the enlarged portion 72 of the slot.

In a preferred embodiment, each of the slots 42, 44, 44' and 52 includes a circular relatively open portion of approximately $\frac{5}{8}$ inch diameter. This open portion transists into a relatively narrow elongated portion having a width of 0.25 inch, e.i., keyhole shaped. This elongated relatively narrow portion preferably is approximately $\frac{5}{8}$ inch in length. Typically, each slot terminates at a location no nearer its respective end of a strap member than about $\frac{3}{8}$ inch.

Figure 4:
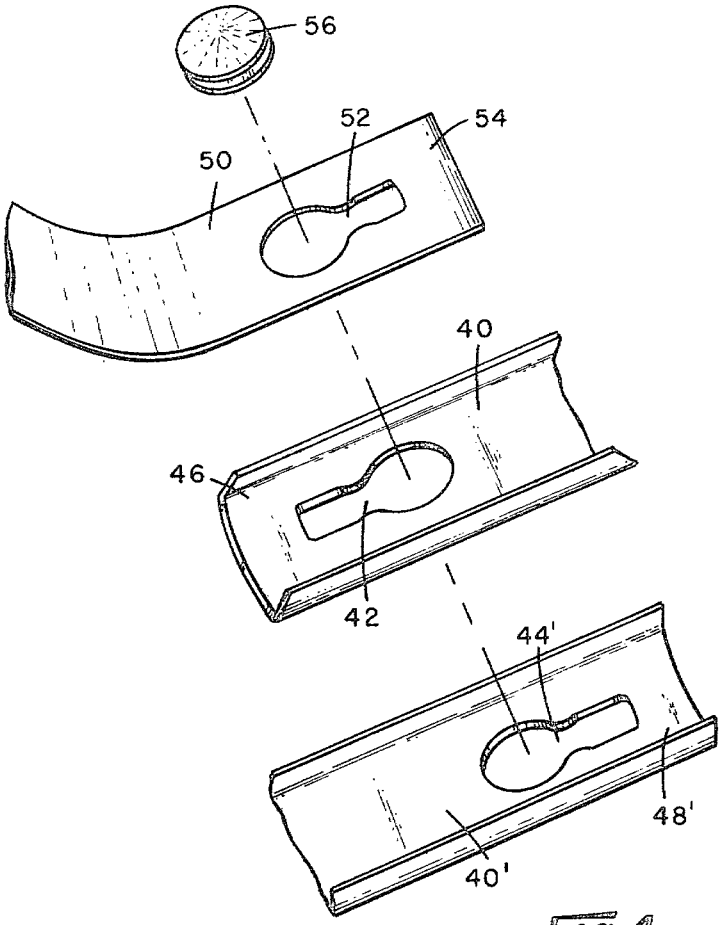
FIG. 4 is an exploded view showing the connection of the several components of the disclosed strap system.
Figure 5:
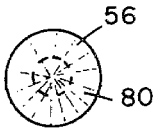
FIG. 5 is a plan view of a button member as disclosed herein.
Figure 6:
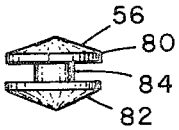
FIG. 6 is a side elevational view of the button shown in FIG. 5.

With reference to FIG. 4, in the disclosed system, a plurality of first strap members 40 and 40' are joined one to another in end-to-end relationship by means of a fastening member 56 received in the slot 42 in the end of the first strap member 40 and the slot 44' in the end 48' of a further first strap member 40', when these slots are in register. The preferred fastening means comprises a double-headed button 56 comprising a first disc-shaped head 80 and a second disc-shaped head 82, such heads 80 and 82 being disposed in substantially parallel relationship to one another and joined one to the other by means of a central shaft 84 that extends transversely to the respective planes of the parallel heads. In the preferred embodiment of the button 56, each of the heads is slightly less than $\frac{5}{8}$ inch diameter so as to be receivable in the open portion 58 of a slot but which will not pass through the relatively narrow portion 60 of the slot. The heads 80 and 82 spaced apart from one another by approximately 0.125 inches. Further, the shaft 84 joining the two heads is of circular cross-section and slightly less than about 0.25 inch in diameter. Thus, when a button is positioned in a slot with one of its heads on one side of a strap member, its other head on the opposite side of the strap member and its shaft 84 residing in the open portion of the slot, the button can be moved toward the nearer end of the strap member to cause the shaft to frictionally pass between the protrusions 62 and 64 in the slot and on into the narrow portion 60 of the slot. Once the shaft is in the narrow portion 60, it will remain there unless urged out by a considerable force. The button, therefore, can be inserted in any given slot in a preassembly operation and will not become dislodged during storage or shipment, but rather will remain in position for further assembly of the several strap members. A button formed of Type SE-1 Noryl thermoplastic resin, a modified phenylene oxide available from General Electric Co. possesses the necessary strength characteristics and is sufficiently "yieldable" as to permit a button shaft of ½ inch diameter to be urged between the protrusions 60 and 62 of a slot 42, for example.

Referring to FIG. 1, in a typical system employing the present strap system for supporting fibrous batts of insulation in the ceiling of a building, commonly the first batt of insulation 84 installed is between the first of the purlins 16 and 18 on the opposite sides of the ridge line of the ceiling roof. The batt of insulation provided between these purlins includes longitudinal reduced thickness tabs along its opposite longitudinal side edges for wrapping the respective purlins. To commence the strap system installation, a first strap member 86 is joined to a second strap member 88 at one of its ends and is further joined to a further second strap member 90 at its opposite end by means of buttons 56. These second strap members are bent to follow the contour of the reduced thickness tab portions of the insulation batt as they wrap the purlin flanges. By this means, the first batt 84 is maintained in position and the strap system is started. Thereafter, a further batt of insulation 87 is provided between the purlins 16 and 14, such further batt having a reduced thickness longitudinal tab 88 only along one of its edges and which wraps the bottom flange of the purlin 14. Once this batt is in position, a further first strap member 92 is connected at its end 94 in end-to-end relation with the first strap member 86 by inserting the head of the button 56 through a slot in the end 94 of the strap member 92. The opposite end 96 of the strap member 92 is connected to a further second strap member 98 by means of a further button, such further second strap member 98 being bent into a conforming relationship with the tab portion of the batt 87 which wraps the bottom flange of the purlin 14. This installation procedure is repeated over the remainder of the ceiling.

The installation procedure referred to above can be carried out by a single person in that the described system permits the preassembly of portions of the strap system, that is, the combination of first and second strap members. This subassembly, for example, strap members 92 and 98 of FIG. 1, can then be connected at its end 94 to the previously installed strap member 86, rotated to a position out of the way of the workman and left hanging as he installs a subsequent batt of insulation. Thereupon, he can grasp the hanging subassembly, swing it into position and secure it to the purlin for holding the insulation batt in position.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed:

1. A system of strapping comprising in combination a plurality of first strap members connected in end-to-end relation, a second strap member connected to said first strap member at the site of joinder between adjacent ones of said first strap members employing a single fastening means, including means defining a slot adjacent one end of each of said members and through the thickness dimension thereof, said slot including a relatively open end portion and a connecting relatively narrow portion, said relatively narrow portion of said slot being closer to the respective adjacent end of its respective strap member than said relatively open end portion of said slot, and fastening means including opposed head portions interconnected by shaft means, one of said head portions being of a size which is receivable through said relatively open end portion of said slot and said shaft means being of a size which is receivable in said relatively narrow portion of said slot when one head of said fastening means is on each of opposite sides of said strap member, whereby said second strap member is connected to said first strap members at the site of joinder between adjacent ones of said first strap members employing a single fastening means.

2. The system of claim 1 wherein said second strap member is of a length which is substantially less than the length of the other of said first strap members.

3. The strap system of claim 1 wherein said second strap member comprises a bendable material which retains its bent geometry.

4. Th strap system of claim 1 wherein said first strap member comprises a length of semi-rigid material having a generally "U"-shaped cross-section.

5. A system for strapping an insulative batt between adjacent purlins or like support members of a building comprising in combination a first strap member having a first end and a second end and a second strap member having a first end and a second end, said second strap member comprising a bendable material, said first end of said second strap member being bent around said purlin or like support member, said first end of said first strap member being connected to said building, and means for connecting said second ends of said first and second strap members in end-to-end relationships including means defining a slot adjacent to said second end of each of said strap members and through the thickness dimension thereof, each of said slots including a relatively open end portion and a connecting relatively narrow portion, said relatively narrow portion of each said slot being closer to the second end of its said respective strap member than said relatively open end portion of said slot, and fastening means including opposed head portions interconnected by shaft means, one of said head portions being of a size which is receivable through said relatively open end portion of said slot and said shaft means being of a size which is receivable in said relatively narrow portion of said slot when one head of said fastening means is on each of opposite sides of a strap member.

* * * * *